US010828225B2

(12) United States Patent
Bressi et al.

(10) Patent No.: US 10,828,225 B2
(45) Date of Patent: Nov. 10, 2020

(54) NON-SLIP SELF-SUPPORTING ORTHOPEDIC DEVICE

(71) Applicants: Giuliano Bressi, Monterotondo (IT); Mariano Ciuchetti, Monterotondo (IT)

(72) Inventors: Giuliano Bressi, Monterotondo (IT); Mariano Ciuchetti, Monterotondo (IT)

( * ) Notice: Subject to any disclaimer, the term of this patent is extended or adjusted under 35 U.S.C. 154(b) by 0 days.

(21) Appl. No.: 16/603,370

(22) PCT Filed: Apr. 6, 2018

(86) PCT No.: PCT/IB2018/052389

§ 371 (c)(1),
(2) Date: Oct. 7, 2019

(87) PCT Pub. No.: WO2018/189631

PCT Pub. Date: Oct. 18, 2018

(65) Prior Publication Data

US 2020/0054516 A1 Feb. 20, 2020

(30) Foreign Application Priority Data

Apr. 10, 2017 (IT) ..... 102017000039040

(51) Int. Cl.
*A61H 3/02* (2006.01)
*A45B 9/04* (2006.01)

(52) U.S. Cl.
CPC ..... *A61H 3/0244* (2013.01); *A45B 9/04* (2013.01); *A61H 3/0288* (2013.01); *A61H 2003/0205* (2013.01); *A61H 2003/0272* (2013.01)

(58) Field of Classification Search
CPC ..... A61H 3/0244; A61H 2003/0272; A61H 3/0288; A61H 2003/0205; A45B 9/04
See application file for complete search history.

(56) References Cited

U.S. PATENT DOCUMENTS 5,533,536 A 7/1996 Hong

FOREIGN PATENT DOCUMENTS

CN 102 224 982 10/2011
DE 296 04 595 8/1996
(Continued)

OTHER PUBLICATIONS

International Search Report, PCT/IB2018/052389, dated Jun. 25, 2018.
Written Opinion, PCT/IB2018/052389, dated Jun. 25, 2018.

*Primary Examiner* — David R Dunn
*Assistant Examiner* — Danielle Jackson
(74) *Attorney, Agent, or Firm* — Nixon & Vanderhye

(57) ABSTRACT

A non-slip self-supporting orthopedic device includes: an upper disk slidably engaged with the rod and externally provided with a hinge; a lower disk, connected with the orthopedic device allowing the elastomeric foot to project downward, and externally provided with a hinge; and arms with upper element, lower element and spring adapted to hold the arm in folded configuration. The movable mechanism can take an enlarged configuration, in which the upper disk contacts the lower disk and the arms are folded. In an elongated configuration, the arms are in axial configuration following the pressing of a button connected to a kinematic mechanism causing the arms to take the axial configuration. The reversible connection system allows the reversible disconnection of the lower elements of the arms preselected by the hinge, determining the lifting of the entire arm in a vertical position by rotation around the hinge.

20 Claims, 5 Drawing Sheets

(56) References Cited

FOREIGN PATENT DOCUMENTS

| | | |
|---|---|---|
| FR | 2 973 201 | 10/2012 |
| JP | 2008-188325 | 8/2008 |
| JP | 2015-000191 | 1/2015 |

NON-SLIP SELF-SUPPORTING ORTHOPEDIC DEVICE

FIELD OF THE ART

The present invention operates in the field of orthopedic devices; in particular, this is a particular type of crutch for traumatized users or users with motor difficulties. From a wider perspective, the present invention can also be applied to umbrellas or any other type of device provided with a central rod in order to make it self-supporting.

PRIOR ART

Orthopedics is the medical discipline that studies the locomotor apparatus and its pathologies. The first orthopedic devices appeared in the 4th century BC by merit of Hippocrates, who designed a wood table that was to reduce luxations and fractures, according to the principle of immobilization of the bone or of the articulation.

Among the various instruments used today for assisting with the rehabilitation of a patient following a trauma, crutches are well known. A crutch is a mobility aid used for overcoming a motor difficulty that limits the capacity to walk.

In the case of elderly patients, whose difficulty in walking is not given by a particular trauma but by the physiological aging typical of old age, walking sticks are often used for assisting these users to maintain equilibrium during walking.

Neither crutches nor walking sticks, however, are capable of self-standing in vertical position, i.e. they are not self-supporting.

Orthopedic instruments have been designed which carry out this function, having a base provided with a tripod or a suitable structure that renders them self-supporting.

The projection of the feet at the base of the stick or crutch could in some cases however be a risk for the patient himself/herself. By moving the stick or crutch forward with each step, in fact, the leg of the patient could impact against the feet, further aggravating the walking difficulties.

In order to overcome this problem, several solutions, object of international patents, have been proposed including the patent EP 1 106 161, with title "Self-standing walking stick or crutch". This describes a self-supporting stick or crutch comprising a tubular body within which a motor member is longitudinally extended, actuated by control means, adapted to reversibly fold at least three support legs. Said motor member also comprises a shock absorber member, adapted to prevent the breakage of the legs if they are accidentally tread-on or hit.

Even if the invention described in the abovementioned patent effectively resolves the above-discussed problems, the production of a similar crutch or stick is very complicated as well as costly. The activation of the motor member that causes the exit of the support legs also requires a certain mobility of the hand, which is not always possible, especially in the case of elderly patients.

Therefore, the object of the present invention is to propose a new and innovative self-supporting crutch that effectively resolves the abovementioned problems and which is simultaneously easy to make.

A further object of the present invention is to describe a device applicable on an existing crutch or stick in order to make it self-supporting.

DESCRIPTION OF THE INVENTION

According to the present invention, a non-slip and self-supporting orthopedic device is made that effectively resolves the aforesaid problems.

Advantageously, the orthopedic device consisting of a common crutch or a common walking stick provided with a rod whose lower end is provided with an elastomeric foot and whose upper end is provided with a handle adapted to be grasped by the user.

In proximity to the lower end of the rod, a movable mechanism is present that is constituted at least by:

- an upper disk consisting of a circular crown provided with a plurality of spokes, preferably three of these, irreversibly engaged with a central disk provided with a central hole. Said central hole is advantageously concentric with said upper disk and is adapted to be slidably engaged with the lower end of said rod. Said upper disk is also advantageously externally provided with at least one first hinge;
- a lower disk, consisting of a circular crown provided with a plurality of spokes, preferably three spokes, firmly connected in proximity to said lower end of said rod of said orthopedic device. Advantageously said lower disk allows said elastomeric foot to project downward and is externally provided with at least one second hinge;
- a plurality of arms, preferably three of these, each of which consisting of an upper element connected above said first hinge, a lower element connected below said second hinge, and a central spring which rotatably connects them. Said central spring consists of a common mechanical element adapted to be elastically deformed when subjected to a load and adapted to return to the initial configuration when released. Said central spring, when released, is adapted to hold said upper element and said lower element of each arm in a folded configuration, in which, due to the rotation of the upper element around said first hinge and said central spring and of the lower element around said second hinge and said central spring, the external surface of each lower element is located in contact with the floor and said upper disk and said lower disk are in contact with each other.

Advantageously, said movable mechanism, when said arms are in folded configuration, is in an enlarged configuration which increases the stability of the orthopedic device, making it self-supporting. Preferably, the external surface of each lower element of each arm is advantageously coated with any one elastomeric material in order to increase the friction with the floor.

By actuating a button placed at the handle of the orthopedic device, the user causes the activation of a kinematic mechanism inside or outside said rod which, by operating on the upper disk of the movable mechanism, makes the latter take an elongated configuration. In said elongated configuration, the upper element and the lower element of each arm are vertically aligned and coaxial with each other in an axial configuration and said upper disk is located at a distance from said lower disk corresponding to the length of said arms in said axial configuration.

Advantageously, the lower end of each arm can be reversibly disconnected from the second hinge. In this manner, by rotating the entire arm upward, the user can decide which arms to use and which to leave in vertical position.

In order to prevent the breakage of the arms or of any other component of the movable mechanism, the material for making the same will preferably be elasticized PVC or any other sufficiently elastic plastic polymer.

In an alternative—though not for this reason less advantageous—version of the present invention, the central spring, when released, is adapted to hold the arms in said axial configuration. Consequently, when the user does not touch the handle, the movable mechanism is found in axial configuration. In this case, the kinematic mechanism that is outside or inside the rod will be configured so as to cause the passage of said movable mechanism to said enlarged configuration when the user presses the relative button placed on the handle of the orthopedic device.

In one embodiment of the present invention, advantageously, said button which causes the activation of the kinematic mechanism is provided with a blocking mechanism that can be conveniently actuated by the user in order to cause the pressing down of the key—and the movable mechanism consequently taking the elongated configuration or enlarged configuration—even when the user has not gripped the handle.

If the kinematic mechanism is external, the movable mechanism can advantageously be completely removable from said rod in order to be applied to any existing crutch, stick, or umbrella.

Advantageously, in one aspect of the present invention, by applying a tangential force said arms are adapted to slide with respect to said first hinge and with respect to said second hinge, in order to be brought into the position preferred by the user.

Independent of the embodiment of the present invention, said upper disk and said lower disk have diameter comprised between 5 cm and 50 cm, preferably 20 cm and said movable mechanism, when in said first elongated configuration, has a height comprised between 10 cm and 50 cm, preferably 25 cm.

Finally, in a version of the orthopedic device that is even safer and with more accessories, such device that is the object of the present invention is provided with a common LED light, placed in proximity to said lower end of said rod. This light serves to illuminate the road on which the user walks and in particular has proven to be useful at night, in dangerous areas and areas with poor visibility. Said LED light, advantageously, is reversibly activatable by means of a common button preferably placed at said handle.

The advantages offered by the present invention are clear in light of the description set forth up to now and will be even clearer due to the enclosed figures and to the relative detailed description.

DESCRIPTION OF THE FIGURES

The invention will be described hereinbelow in at least one preferred embodiment by way of a non-limiting example, with the aid of the enclosed figures, in which.

DETAILED DESCRIPTION OF THE INVENTION

The present invention will now be illustrated by way of a merely non-limiting or non-constraining example, with reference to the figures which illustrate several embodiments relative to the present inventive concept.

Figure 1:
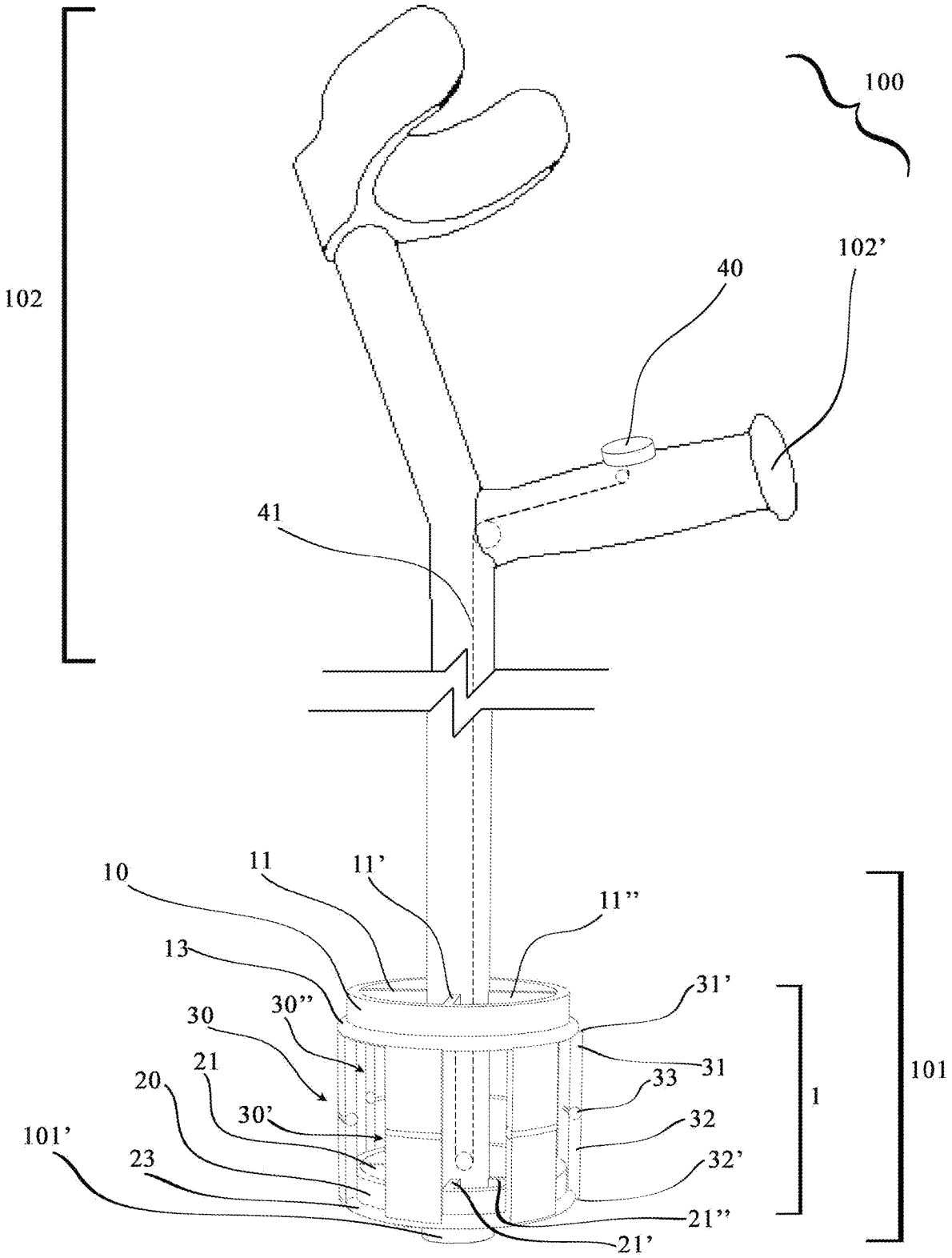
FIG. 1 shows the orthopedic device with the rod 100 provided with the handle 102' on the upper end 102 and with the elastomeric foot 101' on the lower end 101. In proximity to the latter, the movable mechanism 1 is shown in said elongated configuration connected to the internal kinematic mechanism 41 which is actuated by the button 40.

With reference to FIG. 1, an orthopedic device is shown that is represented by a common crutch consisting of a rod 100 with a handle 102' on the upper end 102 and an elastomeric foot 101' on the lower end 101. At the handle 102', a button 40 is seen that is placed in a manner such that when the user grasps the crutch for walking, he/she inevitably presses said button 40 down and activates a kinematic mechanism 41 that is internal (in another embodiment it can be external) with respect to the rod 100 which acts on the movable mechanism 1 placed at the lower end 101 of the rod 100 itself. It is also possible to provide said button 40 with a common blocking mechanism, actuatable by the user, adapted to hold said button 40 down even when the user slackens the grip of the handle 102'.

Figure 2:
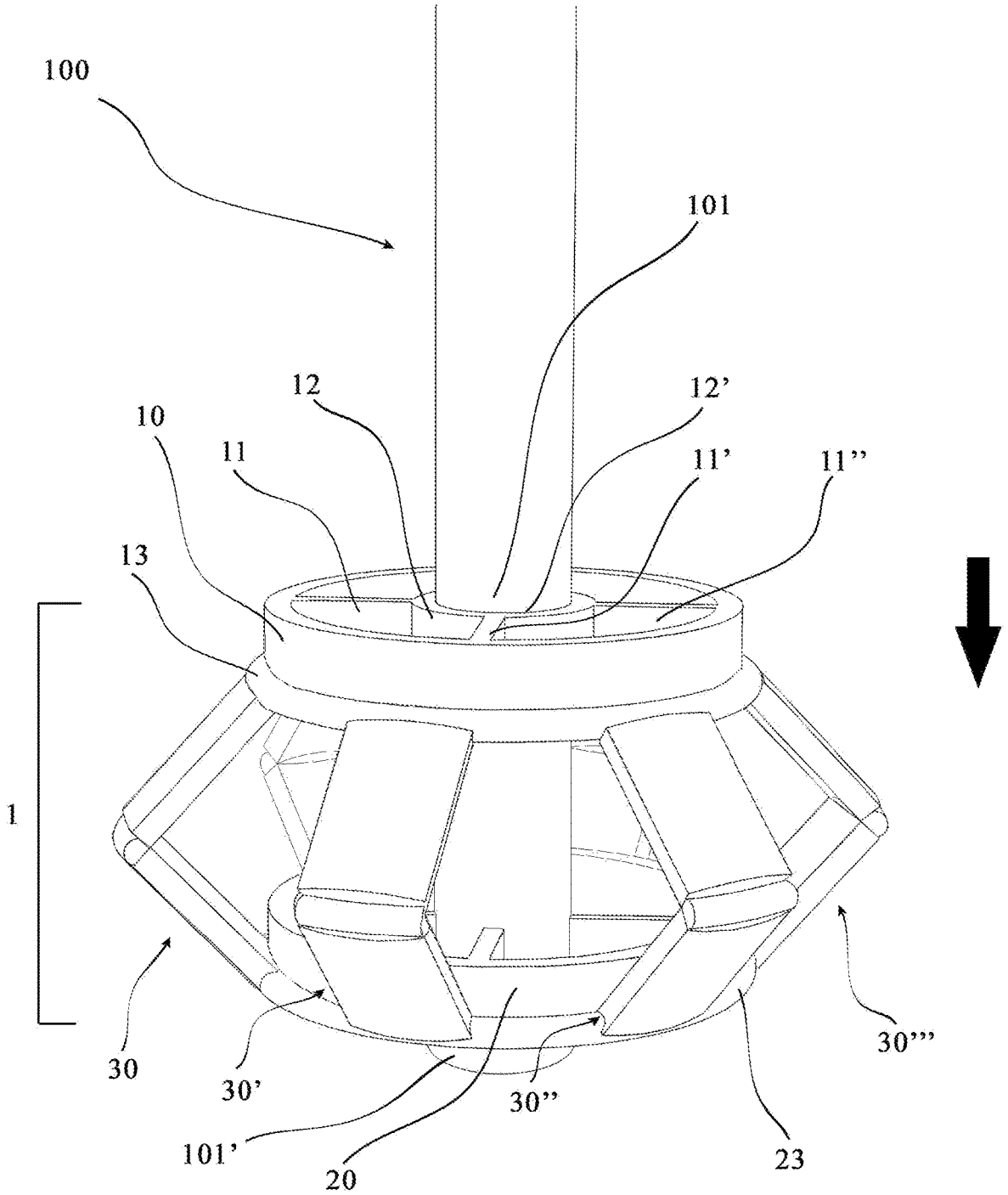
FIG. 2 illustrates the device 1 during the passage from said elongated configuration to said enlarged configuration due to the downward movement (arrow) of the upper disk 10 and due to the arms 30, 30', 30", . . . taking the folded configuration.
Figure 3:
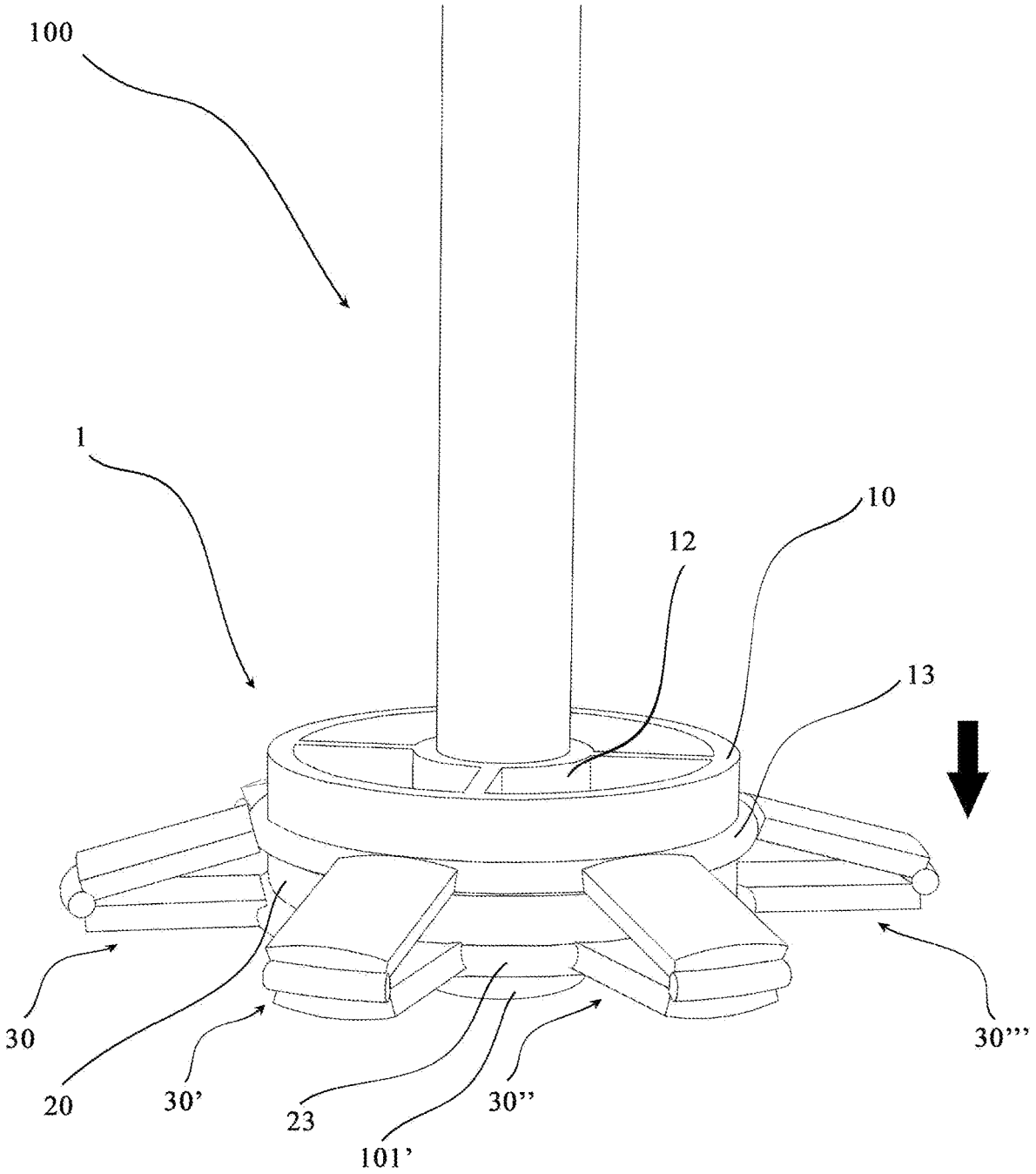
FIG. 3 shows the device 1 in second enlarged configuration in which the arms 30, 30', 30", . . . are in folded configuration and project outward.

In the embodiment represented in FIG. 1, the movable mechanism 1 takes an elongated configuration when released, i.e. when the user does not grasp the crutch. In said elongated configuration, all the arms 30, 30', 30", . . . , are in an axial configuration, i.e. they have the upper element 31 vertically aligned with the lower element 32 and the upper disk 10 is located at a distance from the lower disk 20 equal to the length of the arms 30, 30', 30", . . . . Given that the lower disk 20 is connected in a fixed manner to the rod 100, by means of a plurality of spokes 21, 21', 21", . . . , and given that the upper disk 10 is slidingly connected to the rod 100, by means of a plurality of spokes 11, 11', 11", . . . , which converge in a central disk 12 provided with a central hole 12' within which the rod 100 passes, the kinematic mechanism 41 operates on said upper disk 10. More in detail, when the user, by grasping the crutch by the handle 102', presses the button 40 down, the upper disk 10 is lowered towards the lower disk 20, as shown in FIGS. 2 and 3. FIG. 3 shows the movable mechanism 1 in an enlarged configuration, in which all the arms 30, 30', 30", . . . are in a folded configuration and the upper disk 10 is in contact with the lower disk 20. At the same time, the lower elements 32 of each arm 30, 30', 30", . . . , are in contact with the floor and it is for this reason that their external surfaces 32'" are preferably coated with a common elastomeric material.

Figure 4:
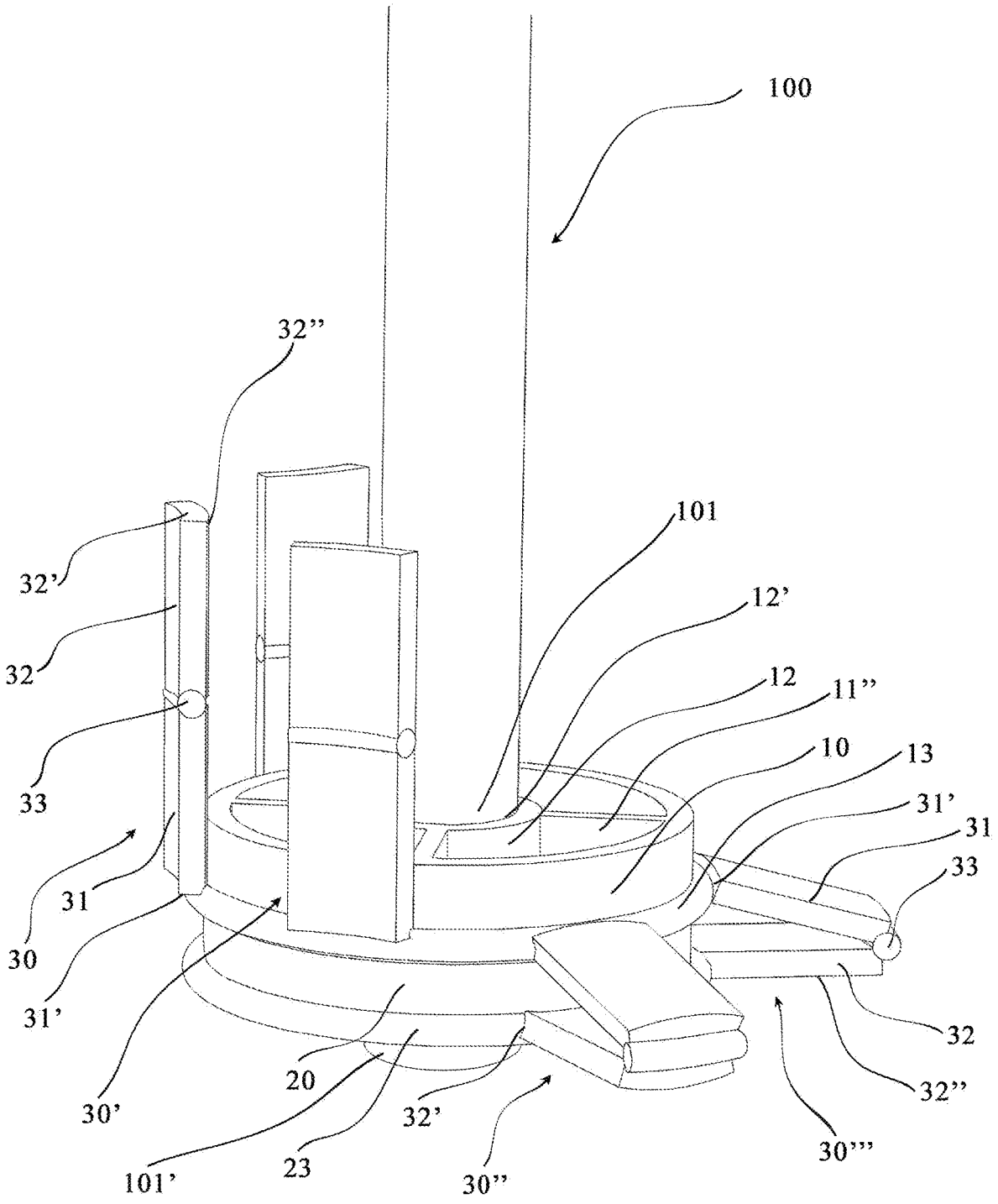
FIG. 4 shows the case in which three of the six arms 30, 30', 30", 30'", . . . are disconnected from the second hinge 23 and are rotated upward, not participating in the passage of the device 1 from the first elongated configuration to the second enlarged configuration.
Figure 5:
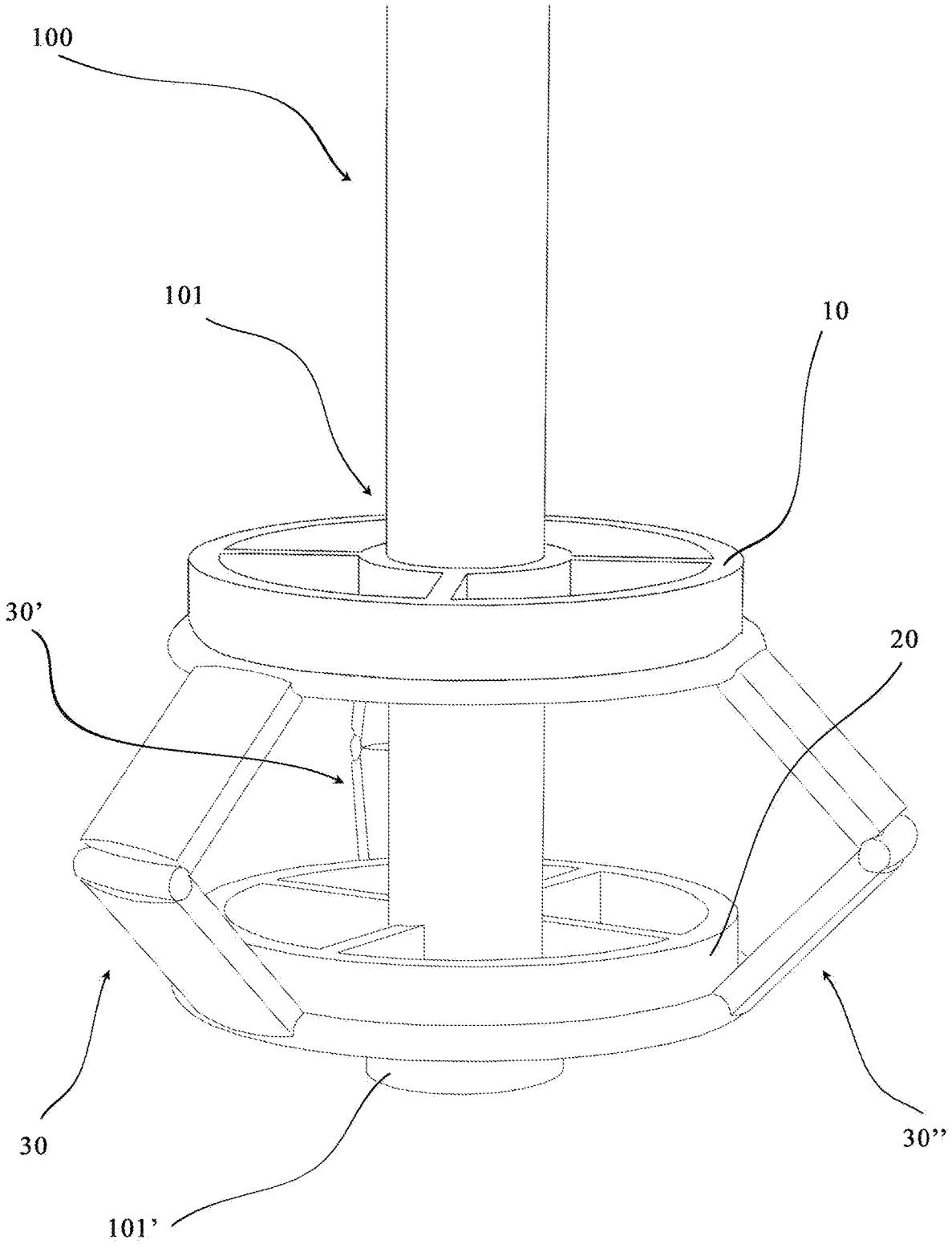
FIG. 5 shows the preferred version of the movable mechanism 1 consisting of three arms 30, 30', 30".

As an alternative to this version, the present orthopedic device can be made in a manner such that, by pressing the button 40, the user causes the passage of the movable mechanism 1 from an enlarged configuration to an elongated configuration, such that during walking the movable mechanism 1 does not impede the user and, by letting go of the crutch, this becomes self-supporting due to the arms 30, 30', 30", . . . , taking said folded configuration. In order to easily allow these frequent changes of configuration, each arm 30, 30', 30", . . . , is provided with a central spring 33 which connects the upper element 31 to the lower element 32. Based on the embodiment type, said central spring 33, when released, will be adapted to hold the upper element 31 and the lower element 32 in said axial configuration or in said folded configuration. Said upper element 31 is rotatably connected to a first hinge 13 placed outside said upper disk 10 by means of the upper end 31' thereof; analogously, the lower end 32' of the lower element 32 of each arm 30, 30', 30", . . . , is rotatably connected to a second hinge 23 externally placed with respect to the lower disk 20. Still in more detail, the connection to said first and said second hinge 13-23 can be of sliding type, in a manner so as to allow the user, by applying tangential force on said arms 30, 30', 30", . . . , to move said arms 30, 30', 30", . . . , into the position that the user deems most opportune. The connection of the lower end 32' of the lower element 32 of each arm 30, 30', 30", . . . , finally, is of reversible type. As seen in FIG. 4, indeed, due to this particular feature, the user can select which arms 30, 30', 30", . . . , to use and which to leave in axial configuration by disconnecting them from the second hinge 23 and rotating them around the first hinge 13.

In order to prevent breakage, due for example to impact with one of the arms in folded configuration, preferably the movable mechanism 1 is made of elasticized PVC.

Possibly, said movable mechanism 1 is completely removable from the rod 100 and in fact constitutes a kit applicable to any umbrella, stick, crutch or other orthopedic devices already present on the market.

Finally, it is clear that modifications, additions or variations that are obvious for a man skilled in the art can be made to the invention described up to now, without departing from the protective scope that is provided by the enclosed claims.

The invention claimed is:

1. A non-slip self-supporting orthopedic device that is a crutch or a walking stick, the orthopedic device comprising:

a rod having a lower end provided with an elastomeric foot and an upper end provided with a handle configured to be grasped by a user; and a movable mechanism provided in proximity to said lower end of said rod, the movable mechanism comprising:

an upper disk including a circular crown provided with a plurality of spokes firmly connected to a central disk provided with a central hole that is concentric with the circular crown of said upper disk, the upper disk configured to be slidingly engaged with said rod of said orthopedic device, said upper disk being externally provided with at least a first hinge, a lower disk including a circular crown provided with a plurality of spokes firmly connected in proximity to said lower end of said rod of said orthopedic device such that said elastomeric foot projects downwards, said lower disk being externally provided with at least a second hinge a plurality of arms, each of the arms including an upper element, a lower element, and a central spring configured to rotatably connect said upper element to the corresponding lower element, said central spring including a mechanical element configured to be elastically deformed when subjected to a load and configured to return to its initial configuration when released;

said upper element of each of the arms being provided with an upper end firmly and rotatably connected to said first hinge of said upper disk, said lower element of each of the arms being provided with a lower end configured to be rotatably engaged, by a non-permanent connection system, with said second hinge, said central spring, when released, being configured to hold said upper element and said lower element of each arm in a folded configuration, wherein, due to the rotation of the upper element around said first hinge and said central spring and of the lower element around said second hinge and said central spring, an external surface of each lower element contacts a floor, and said upper disk and said lower disk contact each other, said movable mechanism being configured to take an enlarged configuration in which said upper disk contacts said lower disk (20) and each of said arms is in said folded configuration, said movable mechanism being configured to take an elongated configuration in which the upper element and the lower element of each arm are vertically aligned and coaxial with each other in an axial configuration, and said upper disk is located at a distance from said lower disk corresponding to the length of said arms in said axial configuration, said elongated configuration occurring following the user pressing a button located at said handle of said orthopedic device, said button being connected to a kinematic mechanism configured to act on said upper disk by determining its upward movement and spacing from said lower disk, thus causing said arms to take said axial configuration, said connection system, located at the lower end of the lower element of each arm being configured to allow disconnection of the lower elements of the arms that are preselected from said second hinge, to cause the entire arm to lift in a vertical position by rotation around said first hinge.

2. The non-slip self-supporting orthopedic device according to claim 1, wherein said kinematic mechanism is located inside said rod.

3. The non-slip self-supporting orthopedic device according to claim 1, wherein said kinematic mechanism is located outside said rod.

4. The non-slip self-supporting orthopedic device according to claim 3, wherein both of said upper disk and said lower disk of said movable mechanism are connected to said rod, in proximity to the lower end of the rod, allowing said movable mechanism to slide along said rod and allowing said movable mechanism to be disconnected from said rod.

5. The non-slip self-supporting orthopedic device according to claim 1, wherein said button is provided with a blocking mechanism configured to hold said button down even when the user releases said handle.

6. The non-slip self-supporting orthopedic device according to claim 1, wherein, by applying a tangential force, said arms are configured to pivot outward relative to said first hinge and relative to said second hinge.

7. The non-slip self-supporting orthopedic device according to claim 1, wherein said external surface of said lower element of each of said arms is provided with a non-slip coating configured to improve adherence of said external surface when contacting the floor in said enlarged configuration.

8. The non-slip self-supporting orthopedic device of claim 7, wherein the non-slip coating comprises an elastomeric plastic polymer.

9. The non-slip self-supporting orthopedic device according to claim 1, wherein said upper disk and said lower disk are between 5 cm and 50 cm in diameter, and wherein, when said device is in said elongated configuration, the device is between 10 cm and 50 cm in height.

10. The non-slip self-supporting orthopedic device of claim 9, wherein said upper disk and said lower disk are 20 cm in diameter, and wherein, when said device is in said elongated configuration, the device is 25 cm in height.

11. The non-slip self-supporting orthopedic device according to claim 1, wherein said upper element and said lower element of each of said arms are made of any elastic-plastic polymer.

12. The non-slip self-supporting orthopedic device of claim 11, wherein the elastic-plastic polymer is elasticized PVC.

13. The non-slip self-supporting orthopedic device of claim 11, wherein the button is located at said handle.

14. The non-slip self-supporting orthopedic device according to claim 1, further comprising a light emitting diode (LED) light, located in proximity to said lower end of said that is reversibly activated by a button.

15. The non-slip self-supporting orthopedic device of claim 1, wherein the plurality of spokes of the upper disk comprise three spokes, the plurality of spokes of the lower disk comprise three spokes, and the plurality of arms of the device comprise three arms.

16. A non-slip self-supporting orthopedic device that is a crutch or a walking stick, the orthopedic device comprising:

a rod having a lower end provided with an elastomeric foot and an upper provided with a handle configured to be grasped a user, a movable mechanism provided in proximity to said lower end of said rod, the movable mechanism comprising:

an upper disk including a circular crown provided with a plurality of spokes firmly connected to a central disk provided with a central hole that is concentric with the circular crown of said upper disk, the upper disk configured to be slidingly engaged with said rod of said orthopedic device, said upper disk being externally provided with at least a first hinge, a lower disk including a circular crown provided with a plurality of spokes firmly connected in proximity to said lower end of said rod of said orthopedic device such that said elastomeric foot projects downwards, said lower disk being externally provided with at least a second hinge, a plurality of arms, each of the arms including an upper element, a lower element, and a central spring configured to rotatably connect said upper element to the corresponding lower element, said central spring including a mechanical element configured to be elastically deformed when subjected to a load and configured to return to its initial configuration when released, said upper element of each arm being provided with an upper end firmly and rotatably connected to said first hinge of said upper disk, said lower element of each arm being provided with a lower end configured to rotatably engage, by a connection system, said second hinge, said central spring, when released, being configured to hold said upper element and said lower element of each of the arms in an axial configuration, the upper element and the lower element of each arm being vertically aligned and coaxial with each other, said movable mechanism being configured to take an elongated configuration in which the upper element and the lower element of each of the arms are vertically aligned and coaxial with each other in said axial configuration, and said upper disk is located at a distance from said lower disk corresponding to the length of said arms in said axial configuration, said movable mechanism being configured to take an enlarged configuration in which said upper disk contacts said lower disk and each of said arms is in a folded configuration, wherein, due to the rotation of the upper element around said first hinge and said central spring, and rotation of the lower element around said second hinge and said central spring, an external surface of each of the lower elements contacts a floor, said enlarged configuration occurring following the user pressing a button located at said handle of said orthopedic device, said button being connected to a kinematic mechanism configured to act on said upper disk by determining its downward movement and approaching said lower disk, thus causing said arms to take said folded configuration, said connection system, located at the lower end of the lower element of each of the arms, being configured to allow disconnection of the lower elements of the arms that are preselected from said second hinge, to cause the entire arm to lift in a vertical position by rotation around said first hinge.

17. The non-slip self-supporting orthopedic device of claim 16, wherein the plurality of spokes of the upper disk comprise three spokes, the plurality of spokes of the lower disk comprise three spokes, and the plurality of arms of the device comprise three arms.

18. The non-slip self-supporting orthopedic device according to claim 16, wherein said kinematic mechanism is located inside said rod.

19. The non-slip self-supporting orthopedic device according to claim 16, wherein said kinematic mechanism is located outside said rod.

20. The non-slip self-supporting orthopedic device according to claim 16, wherein said button is provided with a blocking mechanism configured to hold said button down even when the user releases said handle.

* * * * *